US005421354A

United States Patent [19]

Bolton

[11] Patent Number: 5,421,354

[45] Date of Patent: Jun. 6, 1995

[54] FRAMELESS UMBRELLA AND CANOPY

[76] Inventor: Douglas A. Bolton, 310 S. Jefferson, #25C, Placentia, Calif. 92670

[21] Appl. No.: 82,746

[22] Filed: Jun. 28, 1993

[51] Int. Cl.[6] ..... A45B 19/02

[52] U.S. Cl. ..... 135/19.5; 135/20.2; 135/33.2; 135/98

[58] Field of Search ..... 160/84.1 F, 84.1 D; 135/19.5, 33.2, 98, 100, 20.2, 33.2

[56] References Cited

U.S. PATENT DOCUMENTS

| | | | |
|---|---|---|---|
| 238,365 | 3/1881 | Dennis | 135/19.5 |
| 1,175,585 | 3/1916 | Berman . | |
| 1,677,520 | 7/1928 | Gottesman . | |
| 1,732,867 | 10/1929 | Timblin . | |
| 1,752,821 | 4/1930 | Timblin . | |
| 2,385,937 | 10/1945 | Piechowski . | |
| 2,651,314 | 9/1953 | Hasselquist | 135/100 |
| 3,205,904 | 9/1965 | Kreachbaum . | |
| 4,114,634 | 9/1978 | Hermanson . | |
| 4,182,352 | 1/1980 | Hermanson | 135/19.5 |
| 4,370,993 | 2/1983 | Desaleux et al. . | |
| 4,643,210 | 2/1987 | Feld | 135/20.2 |
| 4,870,983 | 10/1989 | Wang | 135/20.2 |
| 4,934,434 | 6/1990 | Schenbly et al. | 160/84.1 F |
| 5,043,039 | 8/1991 | Swiszez | 160/84.1 D |
| 5,078,195 | 1/1992 | Schön | 160/84.1 D |
| 5,103,848 | 4/1992 | Parsons | 135/20.2 |
| 5,188,160 | 2/1993 | Jelic | 160/84.1 D |
| 5,197,526 | 3/1993 | Schön | 160/84.1 F |

FOREIGN PATENT DOCUMENTS

| | | | |
|---|---|---|---|
| 0440064 | 10/1948 | Italy | 135/19.5 |
| 0686850 | 2/1953 | United Kingdom | 135/19.5 |

*Primary Examiner*—Carl D. Friedman
*Assistant Examiner*—Wynn E. Wood
*Attorney, Agent, or Firm*—Cislo & Thomas

[57] ABSTRACT

A self-supporting umbrella canopy has a high strength-to-weight ratio and the ability to compactly fold flat. The umbrella canopy uses a series of collapsible, closed cross-section cells to provide its support and to provide weather protection for a person or persons below. The closed cross-section cells are attached to each other in series so that the umbrella canopy may conveniently unfurl in a radial manner. Construction of the umbrella canopy lends itself to automated processes. Due to the self-supporting nature of the collapsible, closed cross-section cells, lightweight and inexpensive waterproof materials may be used to construct the umbrella canopy.

16 Claims, 6 Drawing Sheets

FIG. 2
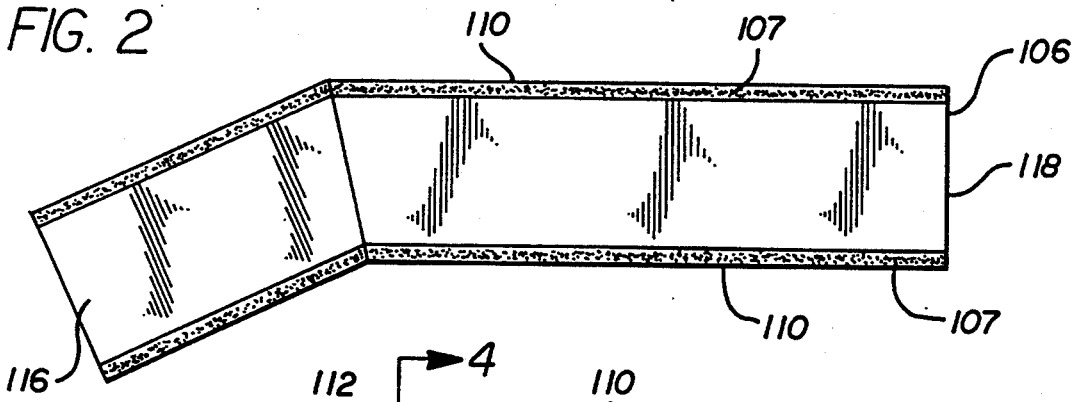
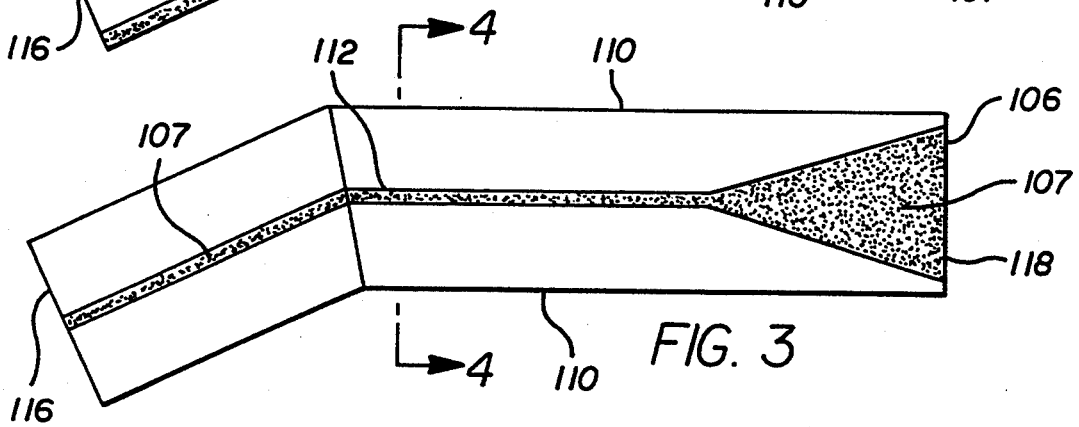
FIG. 3
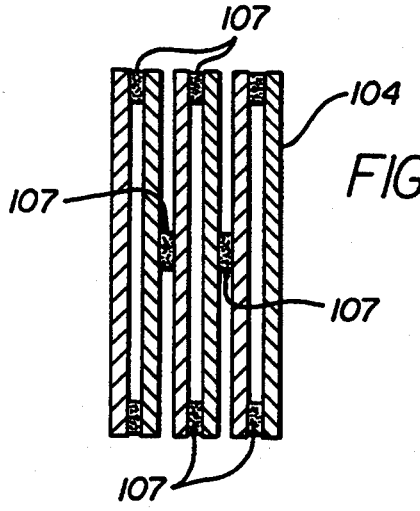
FIG. 4
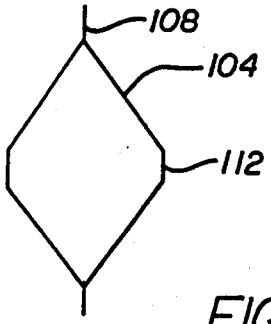
FIG. 5
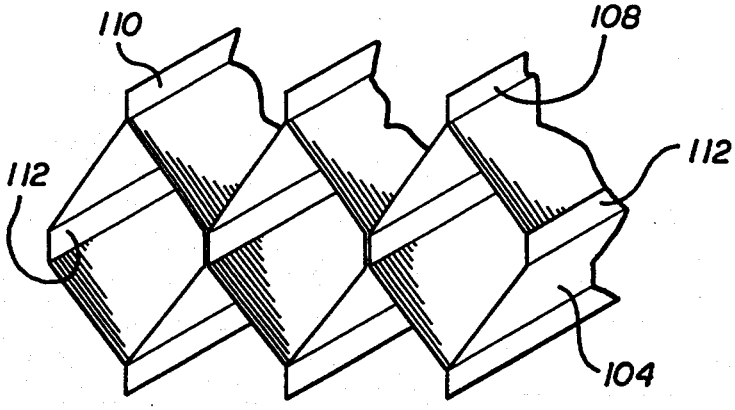
FIG. 6

FIG. 9
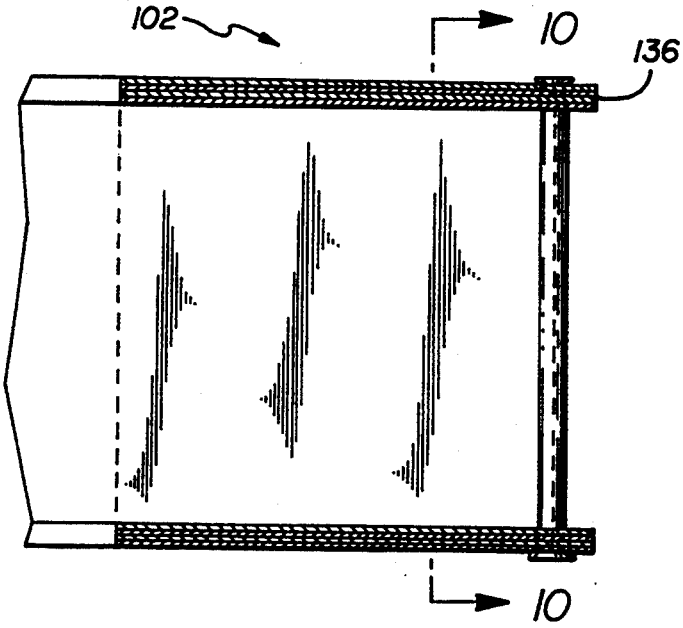
FIG. 10
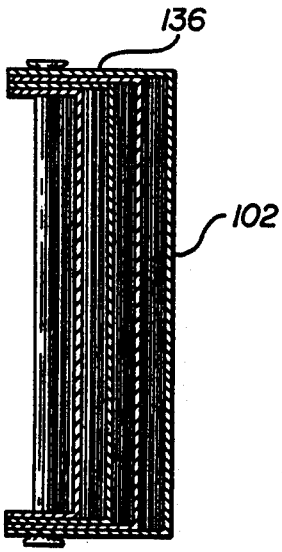
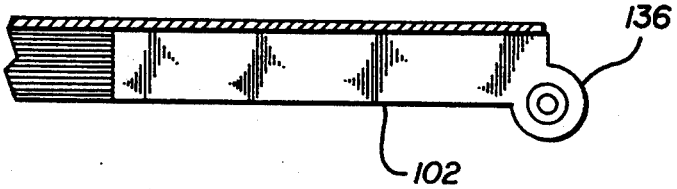
FIG. 11
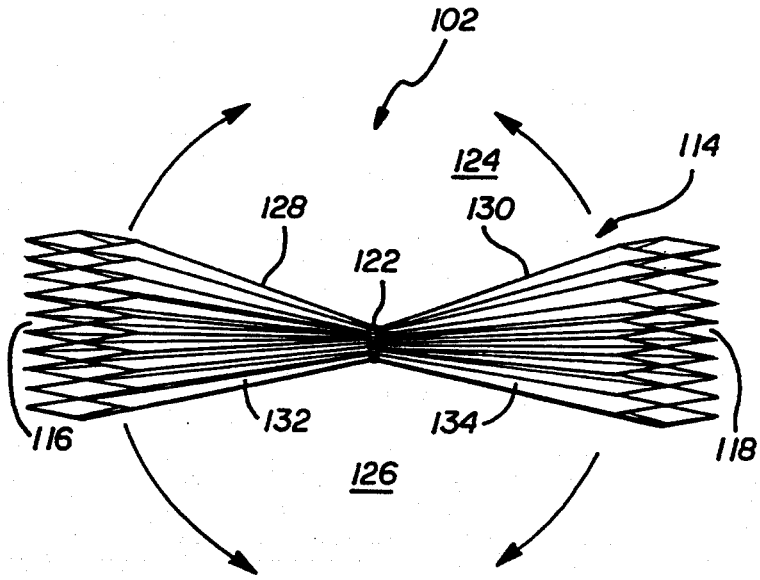
FIG. 21
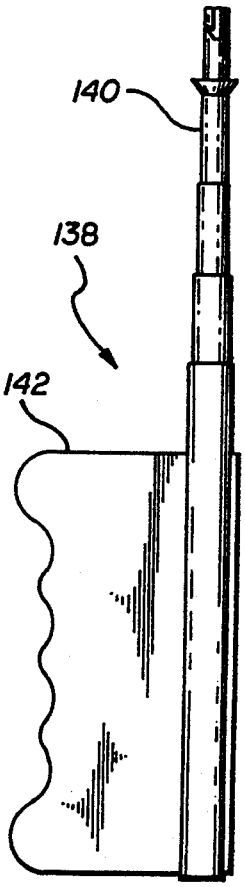
FIG. 12

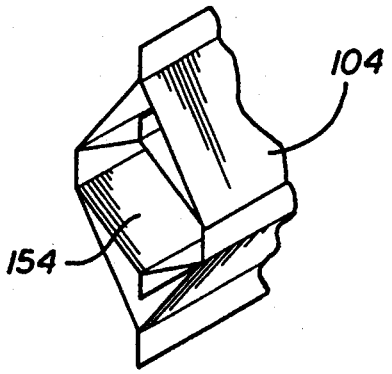
FIG. 14
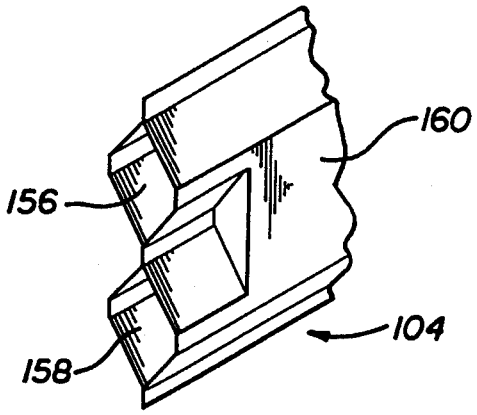
FIG. 15
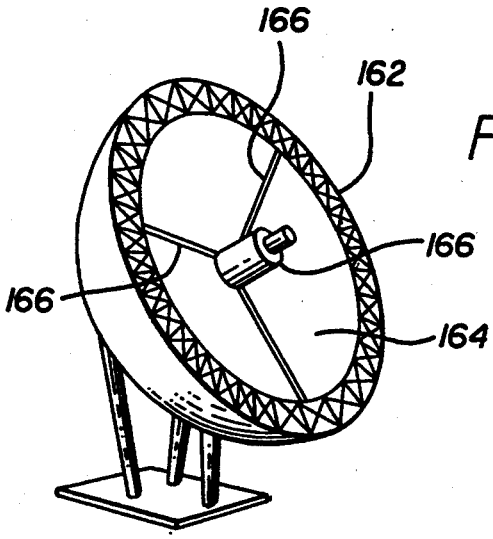
FIG. 16
FIG. 17
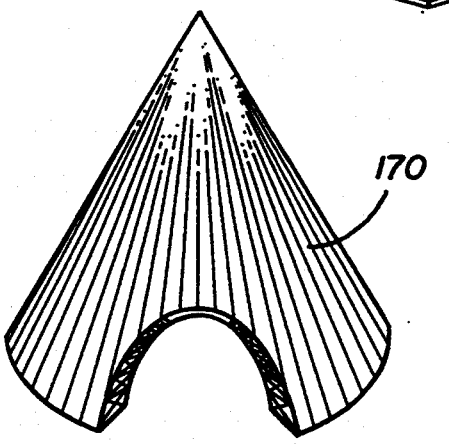
FIG. 18
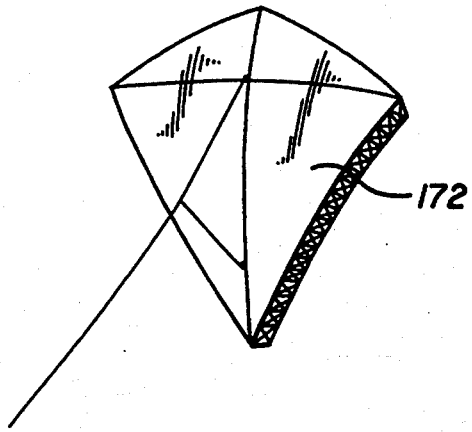

FRAMELESS UMBRELLA AND CANOPY

BACKGROUND OF THE INVENTION

1. Field of the Invention

This invention relates to umbrellas and umbrella canopies, but more particularly to an umbrella canopy that can be folded flat, yet when unfolded provides a strong and lightweight structure to ward off wind and rain.

2. Description of the Related Art including information disclosed under 37 C. F. R. §§1.97–1.98

There are two basic groups of related art that apply to the current invention: conventional umbrellas that use a frame and webbing type construction and umbrellas which use a canopy that combines protective covering and support for the protective covering into one structure. This second group of umbrellas are referred to herein as frameless umbrellas. Frameless umbrellas are typified by those shown in U.S. Pat. Nos. 1,752,821 and 3,205,904 by W. S. Timblin and D. E. Kreachbaum respectively.

Conventional frame and webbing type umbrellas are well known and have been used to protect people from the elements for a number of years. Usually, an umbrella consists primarily of a canopy supported by a frame having ribs. The ribs are hingeably attached to a spreader that is used to furl and unfurl the canopy of the umbrella. The spreader is hingeably attached to a ring that slides along the length of a shank shaft ending in a handle by which the umbrella may be held. As the ring is moved up towards the canopy end of the shank, the canopy of the umbrella unfurls as it is pushed upwards and outwards by the spreader. As the ring is slid down along the shank towards the handle, the ring pulls the spreader downward and inward which furls the umbrella. The ring may have a small slot along one side through which a retractable tab may lodge in order to hold the umbrella in the furled or closed position. Above the canopy at the end of the shank may be an umbrella tip known as a bullet. A sleeve may be used to cover the furled canopy of the umbrella for storage and protection.

The canopy of the umbrella is often made of fabric or some other water resistant material. When unfurled, the canopy fabric is stretched along the ribs of the frame. The ends of the canopy are tied to the rib tips in a taut manner. Variations on the common umbrella also include use of a telescoping handle and a more elaborate framework that allows the canopy to fold in half for compact storage.

Especially with compact umbrellas that are made to fit within a very small space for easy carriage, a significant amount of manual labor is involved in constructing the delicate articulating rib structure that provides the compact umbrella with its small shape and size when furled. This demand for manual labor increases the price of such a compact umbrella with market prices for the most compact conventional umbrellas typically 2 to 3 times that of inexpensive umbrellas of a standard size. Furthermore, with the manufacturing demands of the delicate framework for the compact umbrella, automated processes such as those that might be performed by a machine are limited in use as the individual operations required for the construction of the umbrella demand the flexibility and skill of the human hand.

The structural strength and stability of conventional compact umbrellas is limited due to the delicacy of the framework, and the fact that such framework must be as thin and compact as possible. Delicate frame and webbing type umbrellas are very fragile and easily damaged beyond a usable condition by acts such as mistakenly sitting on such an umbrella when it is left in the seat of an automobile. In addition, the small fragile metal components that make up the framework of a conventional umbrella are easily bent when the umbrella is subjected to harsh conditions. Once these delicate metal components are damaged, the protection provided by the umbrella is reduced and often the umbrella is rendered unusable. A perfect example of such a harsh condition is turbulent wind which does not blow from a constant direction. When the wind changes direction and blows from behind, very frequently a conventional umbrella will blow inside out leaving the user unprotected, and in many cases severely bending the fragile metal components in the umbrella canopy and damaging the umbrella beyond a usable condition.

Although in recent times conventional umbrellas have become relatively compact when compared to their predecessors, they are typically still too bulky to be placed conveniently in a pocket or small purse. As a result, many people still do not carry their umbrellas with them on rainy days to places such as the grocery store where they know that they will have to carry it once they get there. Attempting to carry groceries and an umbrella is a difficult task, especially if the umbrella is wet and cannot be placed in a bag with the groceries. In addition, the cylindrical and relatively long shape of a folded conventional umbrella is inefficient for storage. Most places that a umbrella user may desire to store or carry an umbrella are of a cubical or rectangular shape and in most cases are too small to fit an umbrella. Examples of places where a user may desire to store an umbrella are pockets, briefcases, purses, desk drawers, automobile glove boxes, and all places where a small, flat, rectangular-shaped package would store more efficiently and conveniently than a long cylindrical package. In addition, storing a wet umbrella in these places would be unpractical.

Frameless umbrellas, such as those shown in U.S. Pat. Nos. 3,205,904 and 1,732,867, are constructed of thin flexible material and use an inefficient open cross-section structural configuration. As a result, they cannot provide the level of protection that a conventional umbrella can without being excessively bulky.

It can be seen that advantages can be realized by the manufacture and the making available of a compact umbrella having improved durability; an efficient, high strength structure; and that provides a small lightweight package of a size and shape that is more easily stored and carried when compared to the relevant art.

SUMMARY OF THE INVENTION

The present invention provides a lightweight and compact umbrella canopy that when folded forms a package approximately the size and shape of a common checkbook and can be easily carried by a person in a pocket, purse or brief case. Added to the convenience of having a very lightweight and compact umbrella that is easily carried, the umbrella and umbrella canopy of the present invention are also very strong relative to their weight and offer improved durability when compared to relevant art. The umbrella of the present invention offers protection equivalent to that provided by conventional umbrellas and maintains its geometric stability, that is its shape, when subject to common outdoor stresses such as strong winds and rain. In addition, the present invention offers improved economies of manufacture, requiring much less manual labor to construct when compared to conventional frame and webbing type umbrellas.

The umbrella of the present invention has no frame separate and apart from its canopy. The two are one and the same. The frame and canopy are provided by the same repeated cellular structure that provides the entire canopy. At its most basic level, a collapsible, closed cross-section cell is provided that is joined to the two adjacent collapsible, closed cross-section cells. These closed cross-section cells are joined so that when they unfurl they form the canopy of the umbrella and so that when they furl they fold without suffering any loss of strength. The material from which the cells are made is lightweight and flexible, such as strong plastic or waterproofed paper. While a mere sheet of paper or plastic carried over head would offer very little to protect one from the wind, rain, and other elements, the cellular structure used in the present invention serves to add significant geometrical stability and structural integrity to the unfurled umbrella canopy.

Likewise, similar structures such as electromagnetic receiving dishes, tents, and kites can also benefit by incorporating the cellular structure of the present invention using similar materials adapted for the specific use.

OBJECTS OF THE INVENTION

It is an object of this invention to provide a strong, lightweight, and highly compact umbrella and umbrella canopy.

It is another object of this invention to provide an umbrella canopy that is substantially more adaptable to automated manufacture than previous frame and webbing type umbrellas.

It is also an object of the present invention to provide an umbrella canopy with a superior strength to weight ratio when compared to previous frameless type umbrellas.

It is an object of this invention to provide an umbrella canopy having a highly efficient design using collapsible, closed cross-section cells.

It is an object of the present invention to provide a structured surface such as is used in umbrella canopies, electromagnetic receiving dishes, kites, tents and other temporary shelters, and the like that is strong, lightweight, compact when transported, easily and quickly constructed, and easily manufactured.

These and other objects of the present invention will become more apparent with inspection and review of the following description and accompanying drawings.

BRIEF DESCRIPTION OF THE DRAWINGS

FIG. 2 is a plan view of the interior side of a single sheet used to compose one-half of a single closed cross-section cell like those shown in FIG. 1. The shaded portion shows where adhesive may be used to bond the sheet to another similar sheet to create the closed cross-section cell.

FIG. 3 is a plan view of the exterior side of the single sheet shown in FIG. 2. The shaded portion shows where adhesive may be used to bond cells to one another.

FIG. 4 is a section view taken generally along line 4—4 of FIG. 3 where there are a series of collapsed, parallel, closed cross-section cells as would occur when the umbrella in FIG. 1 is folded. The shaded portions in FIG. 4 show where adhesive is used to form the closed cross-section cells and to join individual cells to adjacent ones.

FIG. 5 is a section view of a single, closed cross-section cell formed by bonding two sheets (such as those shown in FIGS. 2 and 3) together as indicated by the shaded areas of FIG. 2 showing the placement of adhesive. Two joined adhesive portions serve to create flanges at the top and bottom of the cell.

FIG. 6 is a perspective view of a series of joined, parallel, closed cross-section cells such as those shown in FIG. 4, the cells in FIG. 6 being expanded and unfolded. The exterior portions of adjacent cells are joined by adhesive along the areas shaded in FIG. 3.

FIG. 9 is a partial side elevation view of a folded umbrella canopy implementing the present invention showing the folded canopy and center hub.

FIG. 10 is a side sectional view of the folded umbrella canopy of FIG. I taken generally along the line 10—10.

FIG. 11 is a top plan view of the folded umbrella canopy of FIG. 9.

FIG. 12 is a side elevation view of a retractable handle for use in conjunction with the umbrella canopy of the present invention.

FIG. 14 is a partial side perspective view of a single, nested, closed cross-section cell structure.

FIG. 15 is a partial side perspective view of a cellular structure used in the umbrella canopy of the present invention. The cellular structure of FIG. 15 has a bifurcated structure with two cells in the foreground and a unitary structure with but a single cell in the background.

FIG. 16 is a side perspective view of a parabolic electromagnetic receiving dish constructed according to the present invention with a central antenna.

FIG. 17 is a top perspective view of a temporary shelter with an opening, the shelter constructed according to the present invention.

FIG. 18 is a side perspective view of a kite constructed according to the present invention.

FIG. 21 is a top, perspective view of an alternative embodiment of the present invention. Unlike the single unfolding canopy of FIG. 1, the canopy shown in FIG.

Figure 1:
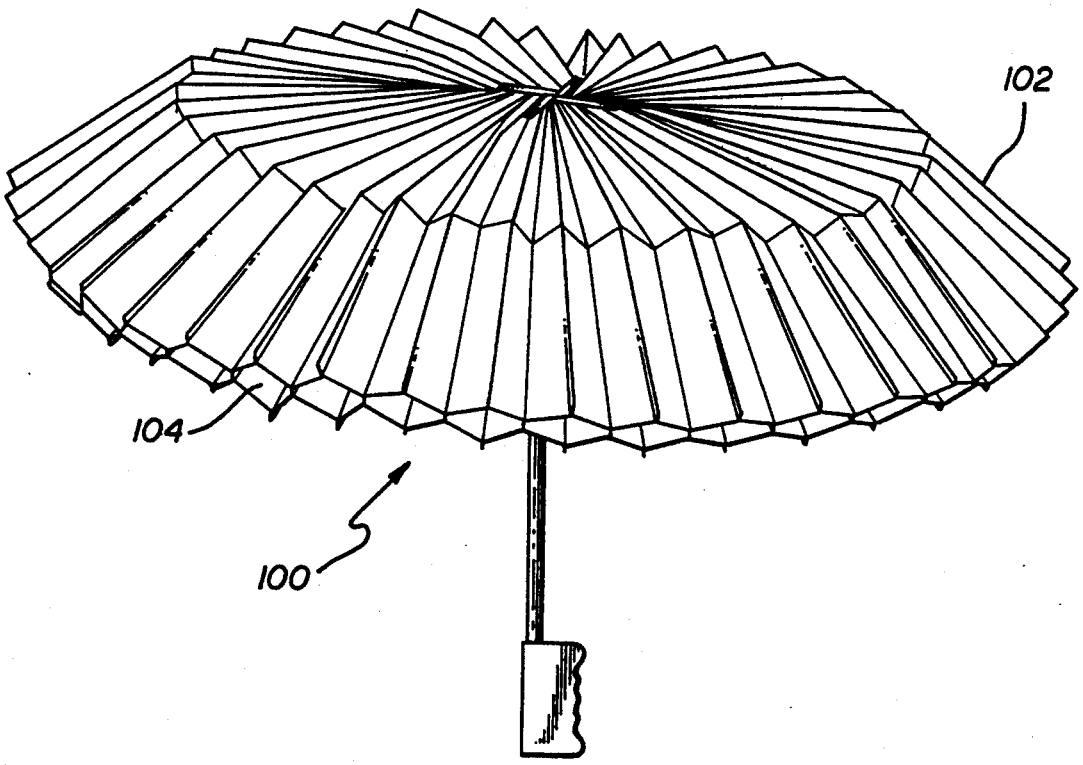
FIG. 1 is a top perspective view of the umbrella and umbrella canopy of the present invention.

21 has two unfolding portions that articulate about a central clasp or hub.

DESCRIPTION OF THE PREFERRED EMBODIMENT(S)

The umbrella 100 and/or umbrella canopy 102 of the present invention are constructed from a series of single, collapsible, closed cross-section cells 104. These closed cross-section cells 104 serve to provide the umbrella canopy 102 with its self-supporting nature and its ability to protect its user from the wind, rain, and sun. In order to better understand the construction of the present invention, description is now made of the basic cellular unit 104 used to construct the umbrella.

The single cells 104 used to construct the umbrella 100 of the present invention are closed cross-section cells 104. These closed cross-section cells 104 add geometric stability to the umbrella canopy so that the umbrella canopy can resist the stresses, forces, and pressures of wind, rain, and other driven elements. The advantages of using closed cross-section elements in order to provide the umbrella canopy 102 are discussed in more detail further below. Description is now made of the actual construction of the closed cross-section cellular elements 104.

The closed cross-section cells 104 of the present invention are made of a resilient material that is folded or formed to create a collapsible tube or cell. Materials that may be used in the present invention include thin plastic, waterproof paper, or any other inexpensive, resilient, and/or waterproof material. Despite the seeming flimsiness of the materials used to construct the cells 104 of the present invention, the cellular structure of the present invention overcomes this flimsiness when the umbrella canopy 102 is unfurled, yet makes use of this flimsiness in order to provide a compact, folded umbrella 100 that is easily stored, carried, and made readily available.

Rectangular or near rectangular blanks 106 can be made of the preferred materials and may either be folded and joined at one edge in order to create a single cell (not shown), or, as indicated in FIGS. 2–6, two blanks 106 may be joined as by adhesive 107 along two edges to form a single cell 104. Flanges 108 at the edges 110 joined to create the cell 104 may or may not be present as is preferred by the market, in order to recognize advantages in the manufacturing process, or in order to change the load-bearing strength of the cell 104. When a plurality of cells 104 have been constructed, they may be joined by adhesive 107 at points or along medial lines 112 running along the exterior sides of the cell 104. Additional cells 104 are joined together in a like manner. Each cell 104 is constructed to provide a collapsible hollow tube that is connected to its adjacent cells along medial 112 lines running along the length of the cell 104 between the flanges 108 of the single cell.

Alternatively, in order to construct a plurality of cells simultaneously, two sheets of thin paper folded lengthwise in a uniform manner may be joined at alternating creases so that the top creases of one, lower thin folded sheet are joined to bottom creases of a second, upper thin folded sheet (none shown). The creases adjacent to the first joined areas are left free and are not joined together. The subsequent creases on either side of the free creases also joined together to construct the first two of several adjacent cells. That is, creases are joined along their length for both sheets in an alternating manner with first corresponding creases joined, second corresponding creases free, and third corresponding creases joined, and so on. In this way, a large number of closed cross-section cells may be formed without the construction of individual cells. The canopy material might also be extruded or molded to form a cellular structure containing a number of adjacent closed cross-section cells.

A number of means may be employed to join the various portions of the umbrella canopy cells 104 together. Adhesive 107 may be used that can withstand normal use. If the canopy cell material will allow it, diffusion bonding such as welding may also serve to join the material together.

Figure 7:
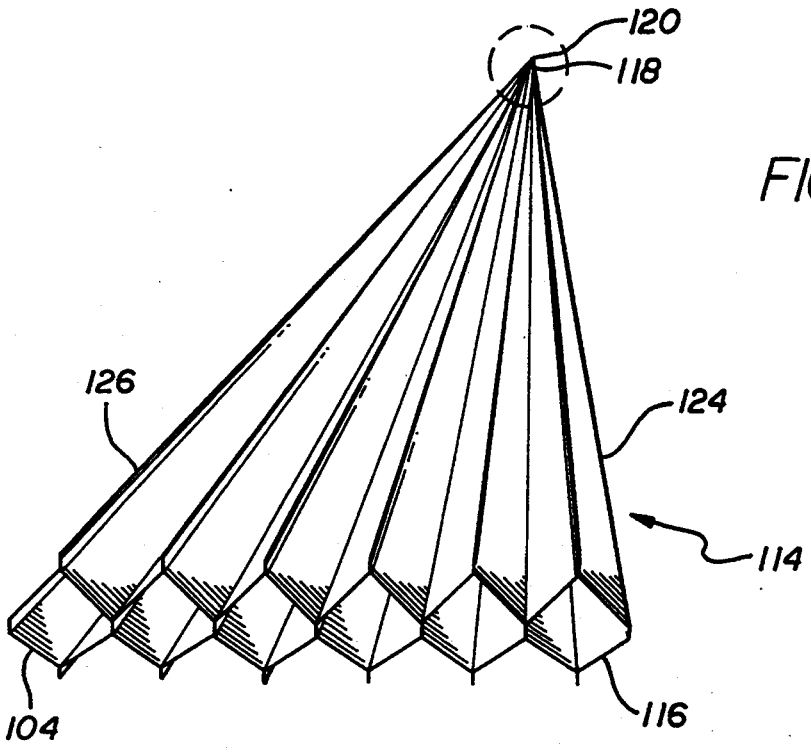
FIG. 7 is a partial perspective view of an unfurled umbrella canopy constructed according to the present invention. The opened, closed cross-section cells extend radially from a central point.

Referring to FIGS. 4, 6 and 7, once a number of cells have been joined together to form a structure sufficiently large to provide an umbrella canopy 102, further construction of the umbrella 100 of the present invention may be pursued.

As currently contemplated, there are two methods or manners in which the umbrella canopy 102 of the present invention may be constructed. After constructing a series of joined cells 114, the construct 114 will now have two open ends 116, 118 leading out from the hollow cells. The open ends 116, 118 provide the umbrella canopy 102 with an open volume configuration which allows the umbrella canopy 102 to easily furl and unfurl. For the first manner of constructing an umbrella canopy, one of the free ends 118 of the cellular construct 114 can be joined so that the opposite end 116 radiates about a central point 120 to provide a parasol-like canopy 102 easily adapted and used as an umbrella 100.

Similarly, and as shown in FIG. 21, instead of joining the cellular construct 114 at one of the free ends 118, the cellular construct 114 may be joined at a segment 122 central to the two free ends 116, 118 to define two umbrella canopy portions. Unlike joining the one free end 118 and allowing the other free end 116 to radiate about the first end 118, by pinching the cellular construct 114 at its middle 122, two canopy portions are defined and the two ends 116, 118 are now free to radiate about the central segment 122. Depending upon the market, manufacturing concerns, and other factors, either one of these manners of constructing the umbrella canopy 102 may be used. One consideration with respect to a preference between use of either of these is the means by which the free ends 116, 118 of the canopy 102 are joined. Another concern is the ultimate shape of the folded umbrella canopy 102.

In order to join the free ends 116, 118 of an umbrella canopy 102 as set forth above as either radiating from one end 118 or radiating from a middle portion 122 of the cellular construct 114, several means may be used. Among the preferable methods are sewing, diffusion bonding or welding, adhesively bonding, or the use of some type of hub 136 or pivot assembly as shown in FIGS. 9 through 11.

Referring now to FIG. 7 with its singly-radiating canopy, two free sides 124, 126 are present between open exterior end 116 and open interior or central end 118. One way to join the free ends 116, 118 of the cellular construct 114 so that a closed umbrella canopy 102 may be formed includes the use of VELCRO hook and loop fasteners. Advantages present in using hook and loop fasteners are realized by the convenience of their use, the ease of their use, and the generally well accepted nature of their use. In order to advantageously use hook and loop fasteners on the canopy 102 partially shown in FIG. 7, one of the two free sides, e.g. 124, would carry the hook strip generally along its entire length while the other of the two free sides, e.g. 126, would carry the loop strip generally along its entire length. When the two free sides 124, 126 were mated to securely engage the hook and loop fasteners, the umbrella canopy would be secured in its unfurled position.

In reference to FIG. 21, a similar process could take place where hook and loop fasteners could be used to secure the umbrella canopy 102 in an unfurled position. The free sides between the first end 116 and the second end 118 of the cellular construct 114 have been divided into two equal lengths by the central pivot 122. As the free sides 124, 126 have now been bisected, each free side must carry corresponding hook and loop fasteners. For the first free side 124, the first half 128 may carry the hook strip while the second half 130 may carry the loop strip, or vice-versa. Similarly for the second free side 126 where the first half 132 may carry the hook strip and the second half 134 may carry the loop strip. For both sides 124, 126, when the cellular construct 114 in FIG. 21 is folded to form an umbrella canopy 102, the hook and loop fasteners present serve to hold the canopy unfurled.

Depending on the breadth of the hook and loop fastener, no means by which the connection between the hook and loop fasteners may be required in order to make it water tight. However, a water resistant flap may be used to shield the juncture from the entry of water.

Magnetic strips can also be used to close the canopy 102 once it has been unfurled from its folded position. One means by which this may be accomplished is by attaching magnetic strips on one side 124 of the juncture to be closed, and either corresponding metal strips or oppositely polarized magnetic strips on the other side 126 of the juncture. When magnetic strips are used to secure the umbrella canopy 102 closed, a water tight seal is provided between the magnetic strip and its corresponding counterpart.

Other means by which the umbrella canopy can be detachably attached to itself and thereby secure the canopy 102 in place is by providing a flexible groove on one side of the juncture 124 to be closed and a flexible lan that fits within the flexible groove on the other side of the juncture 126. Much like a sealable sandwich or freezer bag, the lan and groove would fit together in order to secure the umbrella canopy 102 shut. Such a lan and groove system provides a water tight seal and is consistent with the use of inexpensive materials such as plastic to provide a compact lightweight and inexpensive umbrella.

Other means also exist by which to seal or close the umbrella canopy 102 so that it detachably attaches to itself. One such other means would be through the use of a temporary adhesive that is currently known in offices for removable notes.

FIGS. 9–11 show various aspects of the umbrella canopy 102 of the current invention when folded and in its most compact form. As can be seen from the partially unfolded form of the umbrella canopy shown in FIG. 13, the umbrella canopy 102 folds into thirds in order to provide an ultimate package the size of a checkbook. A hub 136 serves as a pivoting hinge upon which the folded umbrella canopy 102 may better attain its unfurled position. The hub 136 also serves to eliminate fatigue upon the canopy material as it is the hub which bears the brunt of stresses arising from the opening and closing of the umbrella canopy. The hub 136 may be made of metal or resilient plastic and may have two nested leaves that correspond and are connected to the two free sides 124, 126.

When the umbrella canopy 102 is opened or unfurled, it is first unfolded from its most compact size so that the individual leaves 106 of the closed cross-section cells 104 generally extend the full distance of their length. When first unfolded, the first free side 124 and the second free side 126 are on opposite sides of the collapsed cellular construct 114 that will expand to create the umbrella canopy 102. By rotating the free sides 124, 126 in opposite directions about the hub 136, the formerly collapsed closed cross-section cells expand to form the umbrella canopy 102. When the free sides 124, 126 have sufficiently rotated about the hub 136, they meet and may be joined together by such means as previously set forth to secure the umbrella canopy in its unfurled or open position.

Figure 13:
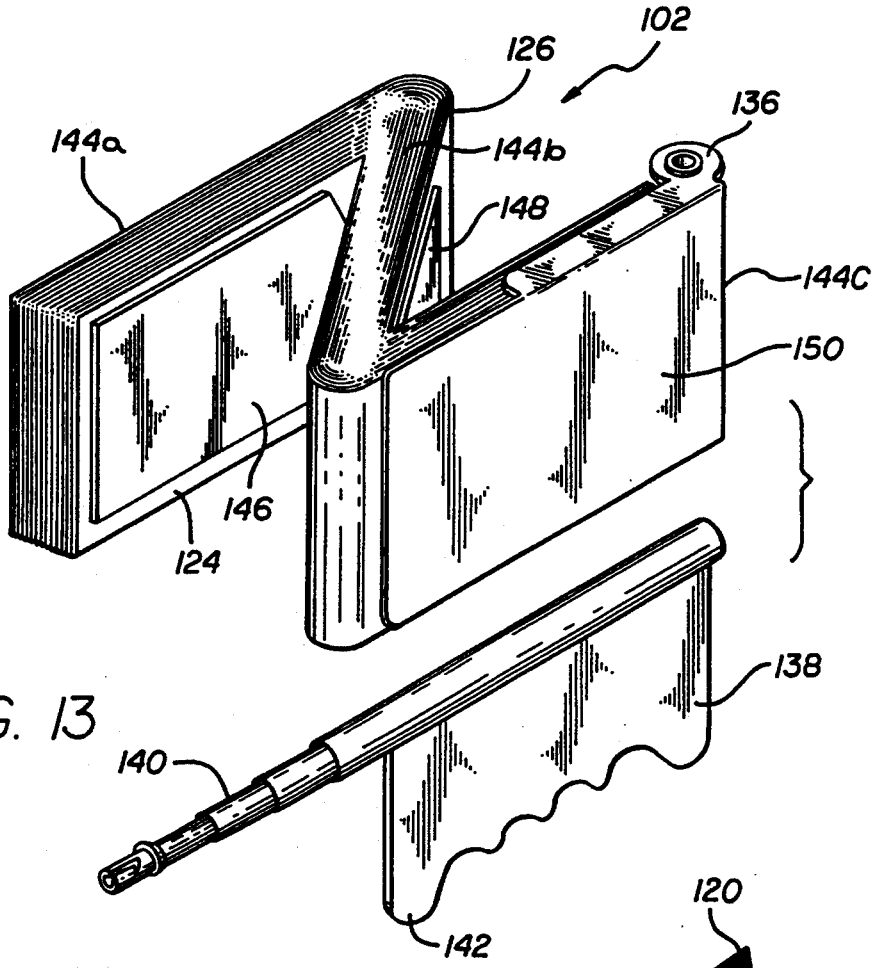
FIG. 13 is a side perspective view of the partially unfolded umbrella canopy with hub of FIG. 9 along with a side perspective view of the retractable handle shown in FIG. 12.

Referring to FIG. 12, a handle 138 may be provided to more conveniently carry the umbrella canopy 102 of the present invention. However, it is contemplated that since the canopy 102 of the present invention is made from thin flexible material, the underside of one of the cells 104 near the center of the umbrella canopy 102 should provide sufficient structure for gripping the present invention with one hand during an emergency. As a result, no handle is required to benefit from the use of this invention. If the handle 138 is provided with the umbrella 100, it is preferably compact such as by a telescoping shank or shaft 140 and should easily and conveniently maintain the compact nature of the umbrella system as a whole. If a hub 136 is provided at the center of the umbrella canopy 102, it is possible for the handle 138 to detachably connect to the hub 136 thereby providing a central support by which the umbrella 100 may be carried. As shown in FIGS. 12 and 13, the handle 138 may also have a magnetic surface 142 or magnetic strip for magnetic attachable detachment to one of the magnetic strips on the umbrella canopy 102 or to a metal hub 136.

When folded, the umbrella canopy 102 may have a plurality of folds **144*a*, 144*b*, 144*c* that serve to make the umbrella canopy 102 more compact. If magnetic strips are used with the umbrella canopy 102, these same magnetic strips may provide means by which the folded umbrella structure may be maintained. With magnetic strips, proper placement may allow both the detachable attachment of the unfurled canopy 102 to itself to provide a shield against the elements, and also provide means by which when folded, the umbrella canopy 102 may maintain its folded shape, the magnetic strips removably detaching to corresponding elements when the umbrella canopy 102** is both furled and unfurled.

Referring now to FIG. 13, magnetic strips are shown attached to the sides of the collapsed canopy 102. On the first free side 124 of the canopy 102, a magnetic strip 146 is attached along the end fold **144*a* of the collapsed canopy 102. This magnetic strip 146 corresponds to a magnetic or metal strip (not shown) on the first free side 124 along the middle fold 144*b*. When the umbrella canopy 102 is folded, the magnetic strip 146 detachably attaches to that corresponding magnetic or metal strip. When the umbrella canopy 102 is unfurled, the magnetic strip 146 corresponds to a magnetic or metal strip (not shown) on the other free side 126 of the umbrella canopy 102, along the end fold 144*a*. When the end magnetic strip 146 on the first free side 124 meets its coupling counterpart on the second free side 126, the end fold 144***a* is detachably attached at both free sides 124, 126 to help hold the umbrella canopy 102 in its unfurled and open position.

Similarly for the other folded sections 144*b*, 144*c* of the umbrella canopy as shown in FIG. 13, magnetic strips 148, 150 can be used to both hold the umbrella canopy 102 in its furled and closed position, and its unfurled and open position. By matching the magnetic strips 148, 150 with corresponding magnetic or metal strips, the umbrella canopy 102 can be held in a detachably attachable manner in either its furled and closed or unfurled and open positions. For the furled and closed position, the magnetic strip 148 on the middle fold 144*b* of the second free side 126 corresponds to a magnetic or metal strip (not shown) on the base fold 144*c* of the same free side. For the unfurled and open position, the magnetic strip 148 corresponds to the magnetic or metal strip (not shown) on the middle fold 144*b* of the first free side 124. This magnetic or metal strip is the same one that corresponds to the magnetic strip 146 on the end fold 144*a* for the furled/closed umbrella canopy 102 position.

The magnetic strip 150 on the base fold 144*c* of the umbrella canopy 102 does not correspond to a magnetic or metal strip on the same free side, but instead faces outward from the folded umbrella structure. If the hand-fitting portion 142 of the handle 138 has a magnetic or metal exterior, the handle 138 may be detachably attached to the base magnetic strip 150 when the umbrella canopy 102 is furled/closed and folded compact. When the umbrella canopy is unfurled and open, the base magnetic strip 150 corresponds and detachably attaches to a magnetic or metal strip (not shown) on the base fold 144*c* of second free side 126. This magnetic or metal strip corresponds to the middle magnetic strip 148 when the umbrella canopy 102 is furled/closed.

From the above description, it can be seen that the end and base magnetic strips 146, 150 are on one free side 124 of the folded umbrella canopy, while the middle magnetic strip 148 is on the opposite free side 126. If magnetic strips are used as the corresponding counterparts to the end, middle, and base magnetic strips 146, 148, 150, then the polarization of all magnetic strips must be arranged so that two corresponding magnetic strips do not repel one another.

If a handle 138 is provided with the umbrella canopy 102, certain accommodations can be made such that the handle 138 fits comfortably adjacent to the folded umbrella canopy 102. By judicious accommodation and design, the folded umbrella canopy 102 may provide a niche or other space for a compact umbrella handle 138.

In use, it is contemplated that the umbrella canopy 102 of the present invention will be easily and quickly retrieved when needed as it occupies a very small space and can be continually carried with the person such as in a pocket, purse, backpack, glove compartment, trunk, or other storage area. Likewise, the compact umbrella canopy 102 of the present invention will occupy little shelf space and several could be stocked at one time by street vendors or at newspaper stands on city streets and boulevards so that an inexpensive umbrella canopy can be made available on demand to the buying public.

In order to unfurl the umbrella canopy 102, the folded form of the umbrella canopy 102 is unfolded so that the cells are predominately straightened. The two free sides 124, 126 of the umbrella canopy are then rotated about the central hub 136 or central area of the canopy 102 to bring the two free sides 124, 126 adjacent to one another so that they may be fixed to one another by one of the previously mentioned means. If the embodiment used for the folding umbrella canopy is that one as shown in FIG. 21 where there are two opposite series of cells, and the cellular structure 114 is attached at a middle point 122, similar means to unfurl the canopy 102 occurs where the corresponding free sides of the umbrella canopy 102 are brought adjacent to one another and detachably attached to form the umbrella canopy 102. For either embodiment, once the umbrella canopy 102 has been unfurled, and the free sides have been detachably attached to one another, the umbrella canopy 102 may have a handle 138 attached to it, or it may be put immediately to use. Due to the preconstruction of the most important elements of the umbrella canopy 102, a sudden downpour need not catch a person by too much surprise, and in a matter of several seconds, the umbrella 100 can be retrieved and put to use.

Several advantages are realized by the umbrella canopy 102 of the present invention when compared to conventional frame and webbing umbrellas, not the least of which is the protection given by the umbrella canopy 102 to the person below it. The umbrella canopy 102 of the present invention is equivalent to previous conventional umbrellas and is not necessarily limited to any specific size or shape. While one embodiment of the umbrella has been shown in FIG. 1 with a flat top and downwardly angled edges, other canopy 102 shapes include flat, conical, and hemispherical canopies.

A further advantage realized by the umbrella canopy 102 of the present invention is that when it is folded, it is much more compact and of a more efficient shape for storage than the frame and webbing type umbrellas of the current relevant art. When the umbrella canopy 102 of the present invention is folded into its most compact form, it occupies a size relatively similar to that of current day checkbooks. The dimensions of a prototype of the present invention measured 6"×3.25"×1". Note that this checkbook size and shape provides for more efficient storage when compared to the cylindrical and relatively long shape of a folded conventional umbrella. Most places that a user of this device may desire to store or carry it are of a cubical or rectangular shape and the flat, rectangular checkbook size and shape of this device will store more efficiently in these places than a long cylindrical shape. Examples of places where a user may desire to store the present invention are pockets, briefcases, purses, desk drawers, and automobile glove boxes. All places where a flat, rectangular checkbook shaped package would store more efficiently and conveniently than a long cylindrical package.

Although in recent times conventional umbrellas have become relatively compact when compared to their predecessors, they are typically still too bulky to be placed conveniently in a pocket or small purse. As a result, many people still do not carry their umbrellas with them on rainy days to places such as the grocery store where they know that they will have to carry it once they get there. It is very inconvenient to carry groceries and an umbrella. However, since the present invention is truly pocket sized, it could be sold with a water tight, snug fitting, carrying pouch similar to a sealable plastic food bag, in which the user could place the present invention upon arriving at places such as the grocery store. The wet umbrella placed inside the water tight pouch could easily be stored in the users pocket with no fear of getting wet, and without the inconvenience of carrying groceries and an umbrella.

Another significant consideration seen as advantageous to the umbrella canopy 102 of the present invention, is that it requires less manual labor to construct and demands materials of lesser cost than those used in conventional frame and webbing type umbrellas. Manufacturing demands of the delicate framework of compact frame and webbing type umbrellas severely limit the use of automated processes such as those that might be performed by a machine. The individual operations required for the construction of the conventional umbrella demand the flexibility and skill of the human hand, and as a result significant manual labor is required. Consequently, umbrellas are typically made in countries where this amount of manual labor is economically justifiable. However, automated construction techniques lend themselves particularly to the present invention which does not require intensive manual labor in order to provide the delicate framework now used in frame and webbing umbrellas. In fact, the majority of the canopy 102 of the present invention can be constructed entirely by machine in a manner similar to printing a book. The process would consist of printing adhesive patterns 107 on a continuous sheet of thin flexible material using a gravure type printing roller to print or dispense the adhesive 107. Next, blanks 106 of the thin flexible material would be cut from the continuous sheet of material using a die type cutting procedure. The blanks 106 would then be collected, stacked and then heated to activate the adhesive and form the cells 104 and the canopy 102.

Tests have been conducted with several prototypes implementing the umbrella canopy 102 of the present invention. A prototype of the canopy 102 of the present invention was attached to a vehicle via a test fixture which was driven at a speed of 50 miles per hour. The surrounding wind was calm, and so the relative force experienced by the umbrella canopy was equivalent to a 50 mile per hour wind. During this test the canopy 102 of the present invention maintained its shape, offering substantially the same amount of protection when experiencing the stresses of a 50 mile per hour wind as it would with no wind at all. No damage or injury was suffered by the umbrella canopy 102 which maintained its integrity and was able to be folded and unfolded in a manner the same as would occur under normal operation.

In its folded state the appearance and durability of the present invention is very similar to that of a closed book. Like a closed book the present invention in its folded state consists of a number of thin sheets stacked one upon the other. As a result, it can withstand substantial harsh treatment and compressive forces when folded. Conversely, delicate frame and webbing type umbrellas are very fragile and easily bent and damaged beyond a usable condition by acts such as mistakenly sitting on such an umbrella when it is left in the seat of an automobile. Tests were conducted to establish the durability of the present invention and in one such test an umbrella prototype implementing the present invention was run over by an automobile and experienced no damage, the folded sheets providing adequate support without ripping, tearing, or otherwise suffering injury or damage.

The improved durability of the present invention when compared to conventional frame and webbing umbrellas is not only present in a folded state. When deployed the present invention provides protection equivalent to that of a conventional umbrella with durability and structural efficiency that surpasses conventional umbrellas. For example, conventional umbrellas use small fragile metal components which are easy bent when the umbrella is accidentally mishandled or subjected to harsh conditions. Once these delicate metal components are damaged the protection provided by the umbrella is reduced and often the umbrella is rendered unusable. A perfect example of such a harsh condition is turbulent wind which does not blow from a constant direction. When the wind changes direction and blows from behind, very frequently a conventional umbrella will blow inside out leaving the user unprotected, and in many cases severely bending the fragile metal components in the umbrella canopy and damaging the umbrella beyond a usable condition.

The canopy 102 of the present invention contains no delicate framework that is subject to bending. If the canopy 102 of the present invention were to be blown inside out, no damage would occur because the canopy is constructed from thin flexible material and could be readily reconfigured for continued use. Stating this point another way, because the canopy structure 102 of the present invention is made from thin flexible material the canopy would fail from a reversible structural failure such as buckling, not a permanent material failure such as the inelastic bending of the metal ribs exhibited by the conventional frame and webbing umbrella.

In summary, a comparison of the canopy 102 of the current invention to the canopy of a conventional frame and webbing umbrella is similar to a comparison of modern day airplanes to the very first airplanes which used a frame and fabric construction. The inefficient, bulky and labor intensive frame and fabric structure was obsolete by the highly efficient semi-monocoque structure used in modern day airplanes. Note that this semi-monocoque construction is similar to the closed cross section cell construction used in the canopy 102 of the present invention.

The main difference between the present invention and previous frameless umbrellas made from thin flexible material such as those in the Timblin and Kreachbaum patents (U.S. Pat. Nos. 1,752,821 and 3,205,904 respectively) is that the canopy 102 of the present invention uses closed cross-section structural cells or elements 104 where previous frameless canopies such as those in the patents mentioned above are constructed from a series of open cross-section elements. Closed cross-section structural elements 104 provide a canopy structure 102 which is much more rigid and geometrically stable than the designs shown in previous umbrellas. Theory and tests indicate that cells or closed cross-section structural elements 104 are many times stronger than the open cross-section elements shown in previous frameless umbrella designs. As a result, the current invention provides a much higher strength to weight ratio than designs shown in previous umbrellas. Stated another way, if someone were to construct one of these previous umbrellas canopies and then construct the canopy 102 of the current invention from the same amount and type of material, the previous umbrella canopy would be many times less rigid and therefore provide less protection than the canopy 102 of the present invention. Alternately, if someone were to construct a previous umbrella canopy as strong as the canopy 102 of the current invention it would require several times the amount of material and therefore would be more expensive and form a much larger package when folded.

The physical reason for the superiority of closed cross-section or cellular elements 104 in structures made from thin flexible material is relatively simple. Structures made from thin flexible material usually fail from geometric instability problems such as buckling. That is, it is not failure of the material within the structure that allows the structure to fail (i.e. the material does not rip, tear or stretch), it is the fact that the structure cannot keep its shape that causes it to fail. The more constrained such a thin walled structure is, the more able it is to keep its shape and therefore carry higher loads. A closed cross-section element or cell is by nature more constrained than an open cross-section element because there are no free edges and all points on its cross-section are constrained by the points around it. However, an open cross-section element has unconstrained free edges making it inherently less constrained and therefore less stable. As a result, closed cross-section structural elements can typically withstand many times the load of an open cross-section structural element made from the same amount of material.

As mentioned above, when a structure is one that is of open cross-section it has free edges that are not constrained or held in position. These free edges of an open cross-section structure are free to move, and have the tendency to contribute to geometric instability, as the movement of the free ends enables the structure to lose its shape.

Closed cross-sections have no free edges, as a result all points of a closed cross-section structure are constrained or held in place by the structure at points adjacent to the one in question. An example will help convey the importance and the significance of using closed (or cellular) as opposed to open cross-section structures.

If one takes two soda pop cans identical in nature and generally available in twelve fluid ounce sizes, an example of the significantly greater strength of a closed cross-section structure can be demonstrated as opposed to a weaker open cross-section structure similar to those used in previous frameless umbrella designs. One of the soda cans is set aside and is not changed in any way, save for that both cans are empty. The other soda can has four slits cut parallel to its length, down its sides, in an opposing manner similar to the four points of the compass. When the two structures are subject to the same stress, the difference in strength between closed and open cross-sectional structures can easily be seen.

The two cans are placed on a flat surface standing upright. When the first can without slits is subject to the stress of a 70 kilogram person standing upon it, no structural damage is inflicted upon the can, and it retains its shape and remains geometrically stable. However, when the same 70 kilogram person stands upon the second empty soda can, the can is crushed, geometric stability is not maintained, and catastrophic failure of the second, slitted soda can occurs.

The only difference between the two cans are the four oppositely opposed slits of the second empty soda can. Both cans possess the same amount of material arranged in substantially the same shape. These four slits along the sides of the second empty soda can allow the four side panels defined by the slits to articulate with respect to one another. This is not true for the first empty soda can, the sides of which are not allowed to articulate with respect to one another and must stand or fall together. The sides of the second empty soda can with the slits, may stand or fall apart separately. The first empty soda can has a closed cross-section structure as there are no slits in it, and a cross-section taken of the soda can perpendicular to the force applied defines a circle and is closed in nature, similar to the closed cross-section elements 104 of the present invention. The second empty soda can with the slits has an open cross-sectional nature and a cross-section taken perpendicular to the force applied sees a number of free edges, two for each slit. The slits present in the second empty soda can allow the four sides defined by the slits to articulate with respect to one another and the points adjacent to one another across the slits are allowed to articulate with respect to one another. This is not true for the first empty soda can, each point on the first soda can side is constrained by the points adjacent to it and so cannot move without affecting the other adjacent points. Adjacent points in the first empty soda can are so tightly bound to one another that the first empty soda can maintains its shape and is geometrically stable when subject to the 70 kilogram stress, whereas the adjacent points along the slits of the second empty soda can may move and articulate allowing the can to be crushed and to suffer catastrophic geometric instability.

In order for the second empty soda can with the slits to maintain its geometric stability, much more material would have to be used in order to overcome the 70 kilogram force applied. The first empty soda can has the same amount of material as was used in the second empty soda can, but due to the structure of the first empty soda can, it is able to withstand a weight several thousand times its own. This example demonstrates the basic difference and advantages of the canopy 102 of the present invention which uses closed cross-section elements or cells when compared to the previous frameless umbrella designs which use canopies constructed of open cross-section elements.

The individual cells 104 of the umbrella canopy 102 of the present invention need not necessarily be circular in shape, but can have any closed cross-sectional shape such as an oval, an ellipse, or any of the many polygons achieved through manufacturing. Different closed cross-sectional shapes may have different strengths or capacities. They may also have certain manufacturing advantages and/or a market appeal.

It is also possible to vary the cell wall thickness as the individual cell travels from the center 120 of the umbrella canopy 102 to its far outer edge 116. Varying the cell wall thickness may improve the ability of the individual cell, and therefore the canopy itself, to withstand greater stress with improved structural efficiency than if the cell wall was not varied.

Similarly, certain structural and/or material efficiencies may be achieved in varying the cross-section of individual cells. In order to realize certain structural advantages, including those of increased load bearing and structural efficiency, the cross-section of a single cell may be varied as it travels from the central interior to the outer exterior of the umbrella canopy 102. One example of such a varied cross-section would be an individual cell that had an oval nature along a vertical axis close to the center 120 of the umbrella canopy 102 while it had an oval nature along the horizontal axis at the outer edges 116 of the umbrella canopy 102.

Flanges 108 are not required in the individual cells of the present invention, but they may add other advantages such as ease of manufacture.

Figure 8:
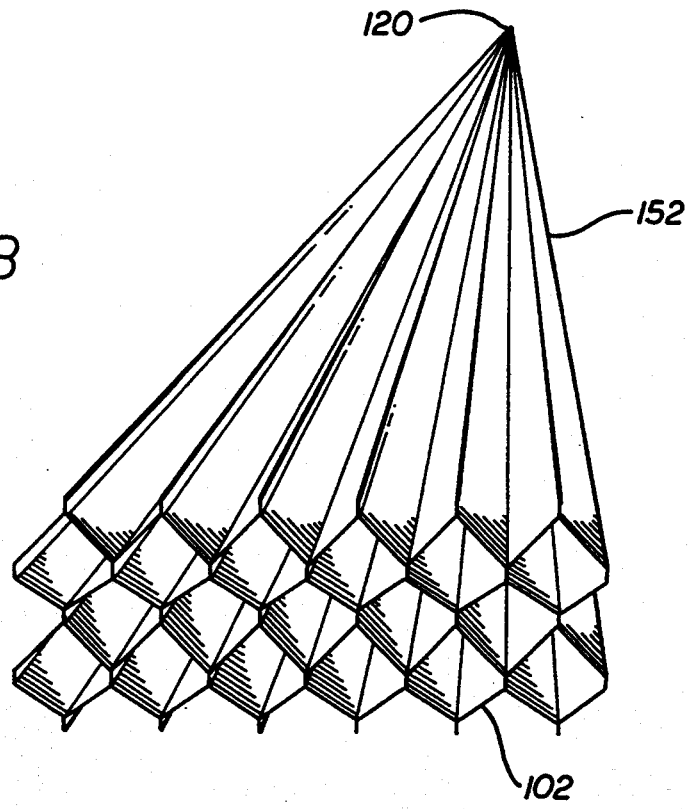
FIG. 8 is a partial perspective view of an unfurled umbrella canopy constructed according to the present invention that uses a plurality of stacked, closed cross-section cells.
Figure 20:
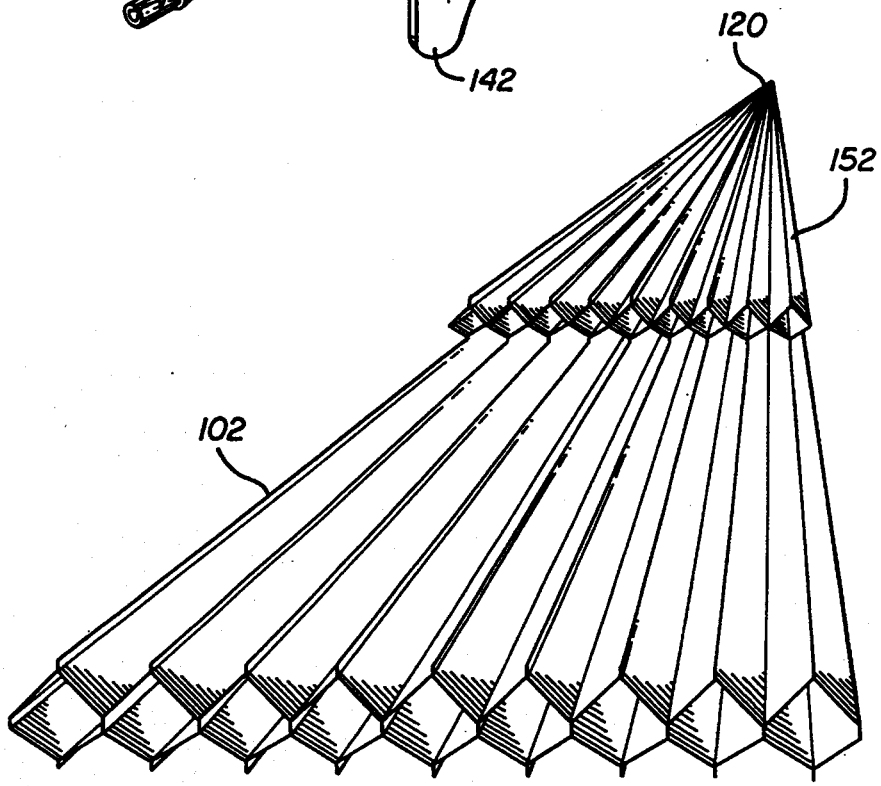
FIG. 20 is a top, perspective, and partial view of an alternative embodiment of the present invention having a central support-enhancing crown and a single cellular layer at its outermost edge.

Referring now to FIGS. 8 and 20, in order to enhance or increase load bearing capacity and strength, multiple layers of cells may be used with the basic umbrella canopy 102 of the present invention. One example of this would be a crown 152 as shown in FIG. 20 placed upon the top of a basic umbrella canopy 102 to provide greater strength towards the center 120 of the umbrella canopy 102. This additional crown 152 may be whole or partial in nature, either realizing an umbrella canopy made of two stacked cellular structures as is shown in FIG. 8, or one that is just stacked toward its center as shown in FIG. 20. Alternatively, the additional layers of closed cross-section cells 152 may be placed below the basic umbrella canopy 102. Although FIGS. 8 and 20 show two layers of closed cross-section cells 152, any number of layers could be used to optimize the rigidity of the structure.

Similarly, closed cross-sectional cells may be nested one inside the other as is shown in FIG. 14. In FIG. 14, a second collapsible, closed cross-section cell 154 is nested inside a first collapsible, closed cross-section cell 104. The internal cell 154 may be joined to the external cell 104 in many different ways, such as at the medial lines or flanges of the cells 154, 104. Further, as shown in FIG. 15, a single cell 104 may be bifurcated with two collapsible tubular sub structures 156, 158 at one end yet unitary and having a single collapsible tubular structure 160 at its outer exterior end in order to provide more strength towards the center of the umbrella canopy 102 or other areas where greater load-bearing is needed. Although FIG. 15 shows a bifurcated closed cross-section cell this cell could be furcated into any number of sub-structures 156, 158 at any location along its length where optimal stability and rigidity was needed.

Other alternative embodiments of the present umbrella canopy invention include flat and conical umbrella canopies. Such flat or conical umbrella canopies are easy to make and are easy to fold into a rectangular shape. Hemispherical or parabolic umbrella canopies may also be constructed along the lines set forth in the present invention, and offer better protection for the user underneath the umbrella canopy so constructed. As mentioned previously, an emergency version of the umbrella canopy 102 of the present invention can be constructed having no handle. Since the canopy 102 of the present invention is made from thin flexible material, the underside of one of the cells 104 near the center of the umbrella canopy 102 should provide sufficient structure for gripping the present invention with one hand during an emergency.

Figure 19:
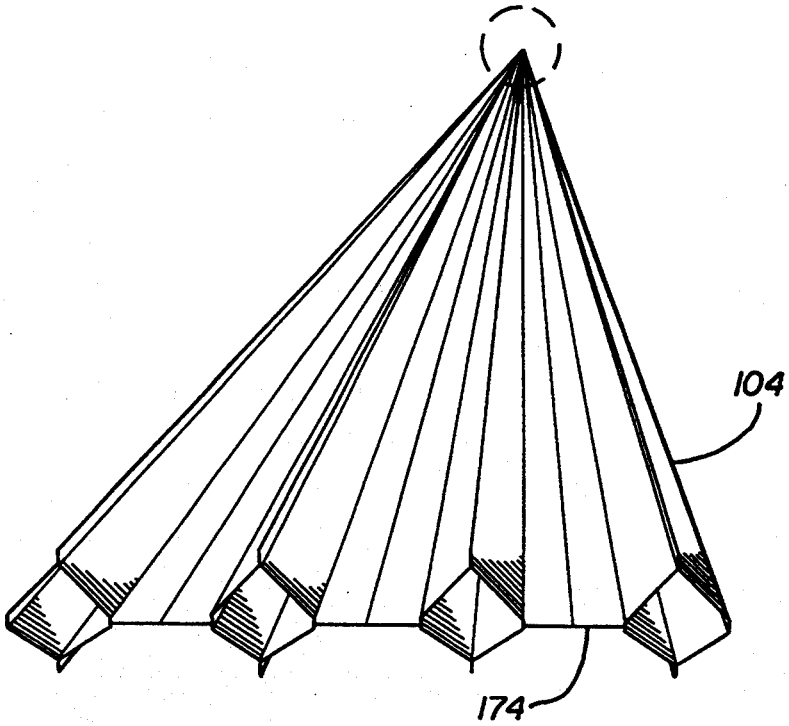
FIG. 19 is a top, perspective, and partial view of an alternative embodiment of the present invention. Individual closed cross-section cells serve as supporting struts between which material is suspended to provide an umbrella canopy.

Another alternative embodiment of the present invention is shown in FIG. 19 where the canopy could use individual cells 104 as struts between which paper, fabric, or plastic webbing 174 could be hung in order to provide an umbrella canopy similar, but distinctly different from, frame and webbing umbrellas in current use.

As shown in FIG. 16, a canopy, or an inverted canopy, or dish may be realized by the present invention as contemplated. When such a canopy is inverted and is constructed to attain a parabolic shape when unfurled, a receiving dish 162 for electromagnetic or sound waves could also be provided that would be very compact when transported yet easily set up and structurally robust when unfurled. It may be advantageous to coat the interior 164 of such a parabolic receiving dish 162 with a material which is reflective to the waves being received, and also provide some structures 166 that would support an antenna 168 that would receive the waves reflected by the parabolic receiving dish 162.

As shown in FIG. 17, a tent 170, or other temporary dwelling may also be realized using a structure similar to the umbrella canopy 102 of the present invention. One such configuration would be a small tepee or hemispherical dome that could be fixed to the ground as by stakes, and thereby provide shelter from wind and rain. The compact nature of such a dwelling makes it especially handy for camping or emergency uses when it is very important to find shelter from harsh ambient environmental elements.

As shown in FIG. 18, a pocket or regular kite 172 constructed along the lines of the umbrella canopy of the present invention may be realized. Such a pocket kite would fold to the compact form, yet unfold into a shape well-recognized as that of a kite or other related structure.

As used herein, the terms "detachably attachable" and the like intend to convey the temporary securement of one structure to another in a firm, but non-permanent manner. When structures are detachable attached to one another, the juncture formed may be broken without inflicting injury to the structures so joined or other structures. When structures are detachably attached, they may be joined to form a firm bond and subsequently separated without damage several, if not innumerable, times.

While the present invention has been described with regards to particular embodiments, it is recognized that additional variations of the present invention may be devised without departing from the inventive concept.

What I claim is:

1. A frameless umbrella canopy, comprising:

a first plurality of joined, closed cross-section, open volume cells, the closed cross-section cells providing structural support for the umbrella canopy and protection from sun, wind, and rain for a user of the umbrella canopy.

2. The frameless umbrella canopy of claim 1, wherein individual cells of the first plurality of cells are joined in a serial manner with a single cell of the first plurality of closed cross-section cells joined to adjacent, neighboring cells on opposite sides of the single cell.

3. The frameless umbrella canopy of claim 2, wherein the first plurality of closed cross-section cells has a first free side detachably attachable to a second free side.

4. The frameless umbrella canopy of claim 3, wherein the first free side carries magnets and the second free side carries a magnetically attractive material so that the first free side is detachably attachable to the second free side by magnetism.

5. The frameless umbrella canopy of claim 3, wherein the first free side has a lan that may be snap fit into and removed from a flexible groove of the second free side so that the first free side is detachably attachable to the second free side by fitting the lan into the groove.

6. The frameless umbrella canopy of claim 3, wherein the first free side carries one half of a hook and loop fastener and the second free side carries an other half of a hook and loop fastener so that the first free side is detachably attachable to the second free side by coupling and uncoupling the two halves of the hook and loop fastener.

7. The frameless umbrella canopy of claim 3, wherein one end of the first plurality of closed cross-section cells are joined to a central hub.

8. The frameless umbrella canopy of claim 1, wherein a first closed cross-section cell is joined to a second closed cross-section cell by webbing.

9. The frameless umbrella canopy of claim 1, wherein the first plurality of closed cross-section cells is centrally secured to provide at least two umbrella canopy portions.

10. The frameless umbrella canopy of claim 1, wherein the first plurality of closed cross-section cells comprises nested closed cross-section cells.

11. The frameless umbrella of claim 1, wherein the first plurality of closed cross-section cells comprises closed cross-section cells that define at least two closed cross-section cellular structures at one portion merging into one closed cross-section cellular structure at another portion.

12. The frameless umbrella canopy of claim 1, further comprising a second plurality of closed cross-section cells, the second plurality of cells are co-axially joined to the first plurality of cells.

13. The frameless umbrella canopy of claim 12, wherein the second plurality of closed cross-section cells partially covers the first plurality of closed cross-section cells.

14. The frameless umbrella canopy of claim 12, wherein the second plurality of closed cross-section cells entirely covers the first plurality of closed cross-section cells.

15. An umbrella comprising:

a frameless umbrella canopy having a plurality of closed cross-section cells joined in a serial manner, the closed cross-section cells providing structural support for the umbrella canopy and protection from sun, wind, and rain for a user of the umbrella canopy, single cells of the plurality of closed cross-section cells joined to adjacent, neighboring cells on opposite sides of the single cells, the plurality of closed cross-section cells having a first free side detachably attachable to a second free side, and one end of plurality of closed cross-section cells joined to a central hub; and a collapsible handle, the handle detachably attaching to the central hub;

the umbrella canopy capable of folding into a small and compact structure for easy carrying and storage.

16. The umbrella of claim 15, wherein the umbrella canopy folds into thirds and the collapsible handle detachably attaches to the folded umbrella canopy to provide a compact umbrella structure that is easily carried and stored.

* * * * *